US005695211A

United States Patent [19]

Challande et al.

[11] Patent Number: 5,695,211

[45] Date of Patent: Dec. 9, 1997

[54] BINDING ELEMENT FOR ALPINE SKIS

[75] Inventors: Christian Challande, Cruseilles; Pascal Thomas, Chambery; Pierre Desarmaux, Evires, all of France

[73] Assignee: Salomon S. A., Metz-Tessy, France

[21] Appl. No.: 756,711

[22] Filed: Nov. 26, 1996

Related U.S. Application Data

[63] Continuation of Ser. No. 273,822, Jul. 12, 1994, abandoned.

[30] Foreign Application Priority Data

Jul. 16, 1993 [FR] France ..... 93 08912

[51] Int. Cl.[6] ..... A63C 9/085

[52] U.S. Cl. ..... 280/625; 280/628; 280/634

[58] Field of Search ..... 280/625, 628, 280/626, 629, 633, 634

[56] References Cited

U.S. PATENT DOCUMENTS

| | | | |
|---|---|---|---|
| Re. 33,388 | 10/1990 | Sedlmair et al. | 280/625 |
| 4,538,828 | 9/1985 | Dimier | 280/628 |
| 4,561,673 | 12/1985 | Pascal et al. | 280/629 |
| 4,660,849 | 4/1987 | Sedlmair et al. | 280/625 |
| 4,735,435 | 4/1988 | Hornschemeyer et al. | 280/625 |
| 4,960,289 | 10/1990 | Stritzl et al. | 280/630 |
| 4,984,816 | 1/1991 | Rullier | 280/625 |
| 5,040,821 | 8/1991 | Berthet et al. | 280/625 |
| 5,044,658 | 9/1991 | Challande et al. | 280/631 |
| 5,092,622 | 3/1992 | Wladar et al. | 280/636 |
| 5,205,575 | 4/1993 | Wlader | 280/625 |
| 5,303,950 | 4/1994 | Rigal et al. | 280/636 |

FOREIGN PATENT DOCUMENTS

| | | | |
|---|---|---|---|
| 0102868 | 12/1986 | European Pat. Off. | A63C 9/085 |
| 0300143 | 1/1989 | European Pat. Off. | A63C 9/085 |
| 0393383 | 10/1990 | European Pat. Off. | A63C 9/08 |
| 2533833 | 4/1984 | France | A63C 9/08 |
| 2640516 | 6/1990 | France | A63C 9/08 |
| 2255406 | 5/1974 | Germany | A63C 9/00 |
| 2905837 | 8/1980 | Germany | A63C 9/085 |
| 3335878 | 4/1984 | Germany | A63C 9/085 |
| 3918938 | 12/1990 | Germany | A63C 9/085 |
| WO 91/08808 | 6/1991 | WIPO | A63C 5/075 |
| WO 91/09654 | 7/1991 | WIPO | A63C 5/075 |

*Primary Examiner*—Richard M. Camby

*Attorney, Agent, or Firm*—Greenblum & Bernstein, P.L.C.

[57] ABSTRACT

The invention is related to a binding element for alpine skis including a base connected to the ski, a body mounted on the base, a boot retention jaw borne by the body, an energy spring housed in the body to elastically oppose the opening movements of the jaw in response to biases of the boot, and a support plate on which the sole of the boot rests. The support plate is configured for being mobile in a rocking motion, and a linking arrangement, sensitive to the rocking motions of the support plate, connect the support plate to one of the mobile members of the binding element to reduce the resistance force that the boot must overcome in order to be released by the jaw in response to a rocking bias exerted on the support plate.

33 Claims, 3 Drawing Sheets

BINDING ELEMENT FOR ALPINE SKIS

CROSS-REFERENCE TO RELATED APPLICATION

This application is a continuation of application Ser. No. 08/273,822, filed on Jul. 12, 1994, now abandoned.

BACKGROUND OF THE INVENTION

1. Field of the Invention

The invention is related to a binding element for alpine skis, intended to retain a boot in support on a ski, and to release the latter in case of excessive bias.

2. Discussion of Background and Material Information

It is known to retain a boot in support on a ski by means of a front binding element and a rear binding element. Each retention element has a jaw carried by a body which is mobile against the return force exerted by an energy spring, generally a compression spring.

More specifically, the invention is related to a front binding element. Usually, the front binding element reacts to a lateral bias of the front end of the boot. Such a bias stems from a pure torsional bias on the skiers leg.

Certain binding elements also react to an upward vertical bias. Such a bias corresponds to a backward fall of the skier. European Patent Application No. 102868, for example, describes such a binding.

Other bindings have a compensation mechanism that reacts in the case of a torsional bias combined with a forward fall of the skier. Such a mechanism is described, for example, in German Patent Publication No. 2905837. This mechanism comprises a vertically mobile boot support plate whose movement, generated by a downward vertical pressure of the boot, reduces the return force that the spring exerts on the jaw.

Another mechanism is described in German Patent Publication No. 3335878. This mechanism also comprises a vertically mobile boot support plate which forces the jaw to be displaced in the direction of the release of the boot.

Such devices compensate for the increased friction from the boot on its supports induced by the forward component of the fall. These mechanisms are satisfactory as long as the lateral component of the fall remains preponderant with respect to the vertical component.

Now, it happens that in the case of certain so-called "front-torsion" falls, i.e., with a forward component and a lateral component, the lateral component is not sufficient to generate lateral tilting of the jaw. A twisting of the boot then occurs, which boot becomes wedged between the jaw and its support plate. Currently known compensation mechanisms are not sufficiently active to generate opening of the jaw. Sometimes these falls are dangerous and cause injuries, in particular in the area of the skier's knees.

SUMMARY OF THE INVENTION

One of the objects of the invention is to propose a binding element that facilitates release of the boot, especially in the case of a front-torsion fall where the lateral component is relatively low.

Another object of the invention is to propose a binding element that is relatively simple to construct.

Other objects and advantages of the invention will become apparent upon reading the following description, this description, however, being provided as a non-limiting example.

The binding element for alpine skis according to the invention comprises the following elements:

a base connected to the ski;

a body mounted on the base;

a boot retention jaw borne by the body;

the jaw comprising two lateral boot retention wings and a vertically retaining sole clamp;

an energy spring housed in the body to elastically oppose the opening movements of the jaw in response to biases of the boot; and a support plate on which the sole of the boot rests.

According to a particular feature of the invention, the support plate is mobile for a rocking motion, and that linking means sensitive to the rocking motions of the support plate connect the support plate to one of the members of the binding element to reduce the resistance force that the boot must overcome in order to be released by the jaw in response to a rocking bias exerted on the support plate.

BRIEF DESCRIPTION OF THE DRAWINGS

The invention is better understood with reference to the description below and the annexed drawings which form an integral portion thereof.

DETAILED DESCRIPTION OF THE PREFERRED EMBODIMENTS

FIGS. 1 to 4 illustrate a first non-limiting embodiment of the invention.

Figure 1:
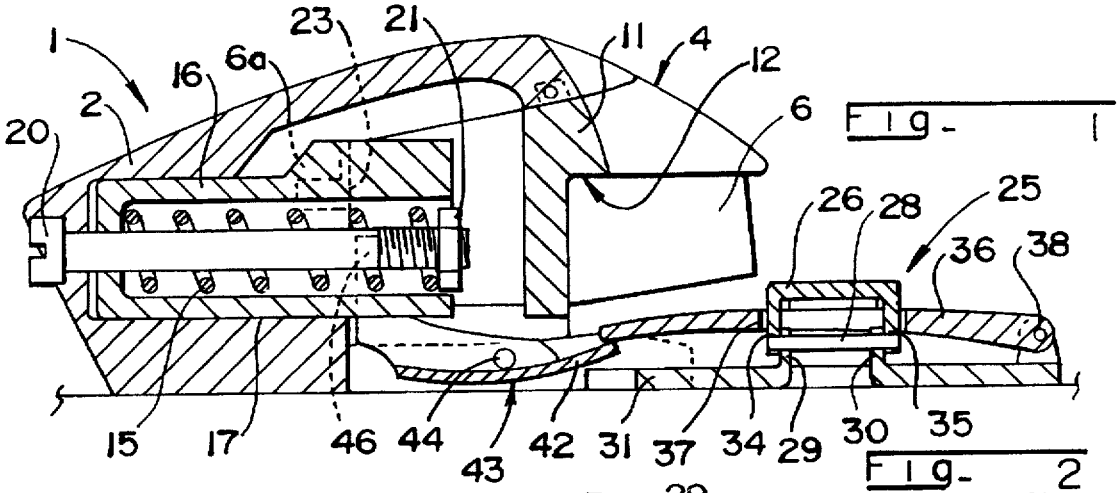
FIG. 1 schematically represents a side and partial sectional view of a front binding element according to a first non-limiting embodiment of the invention.
Figure 2:
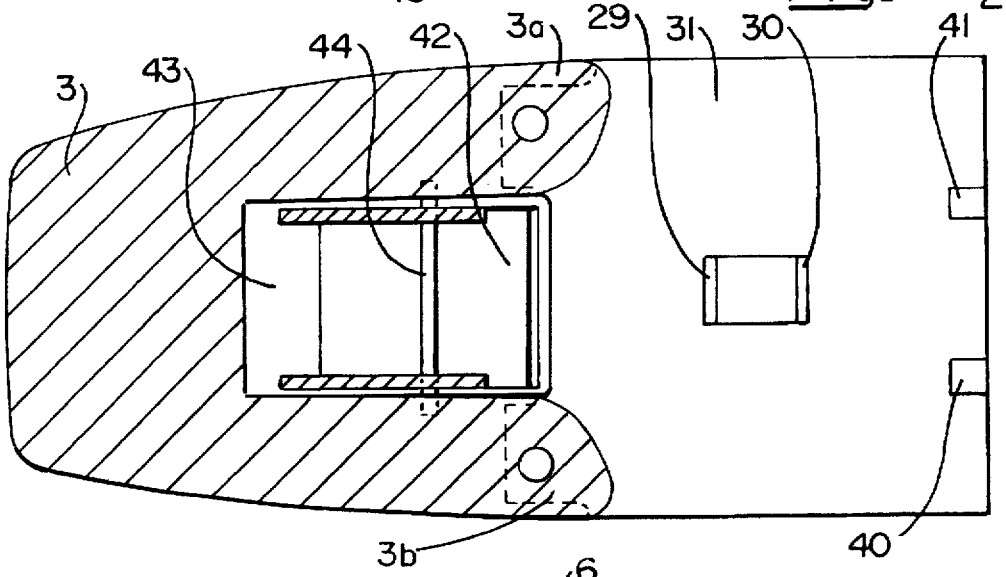
FIG. 2 represents the element of FIG. 1 in top and sectional view at the level of its base.
Figure 3:
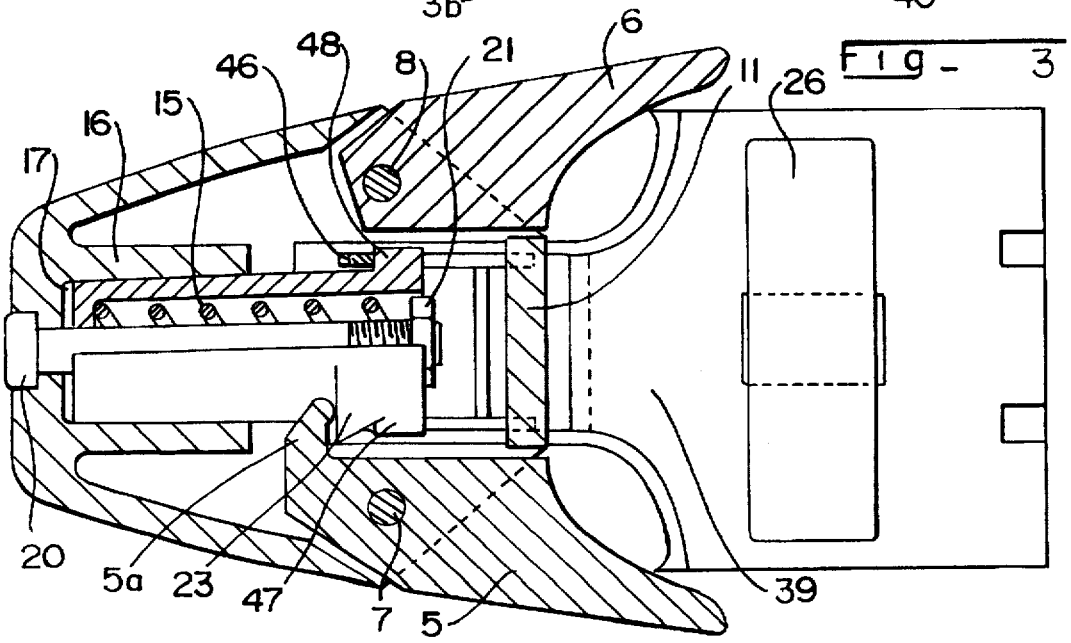
FIG. 3 represents two half-views of the element of FIG. 1, seen from above and sectionally at various altitudes of its mechanism.
Figure 4:
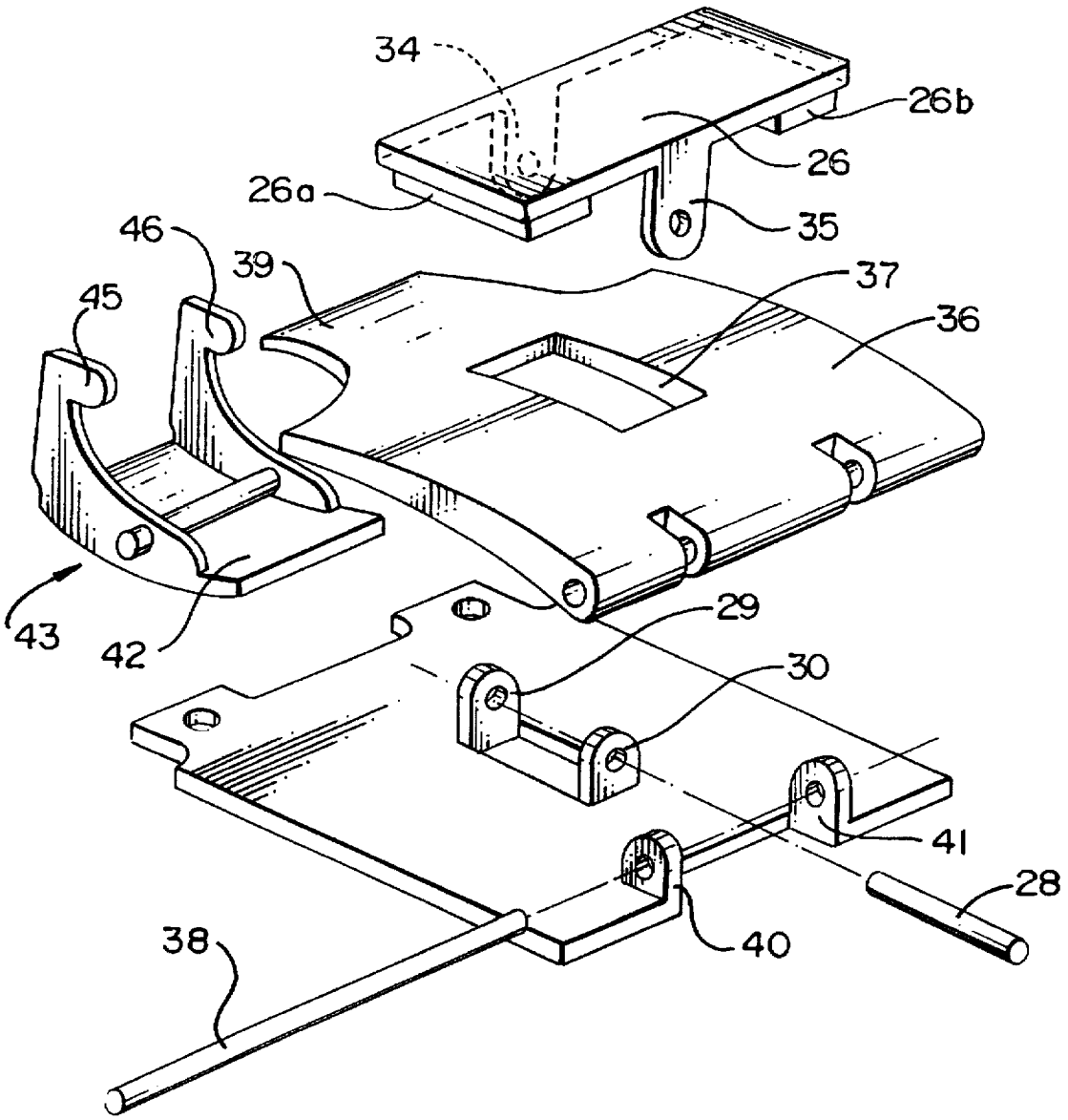
FIG. 4 represents an exploded perspective of the various elements constituting the support device of the boot.

FIG. 1 shows a binding element 1 which, apart from the support device of the boot, has a general structure known, for example, from French Patent Publication No. 2640516. However, only the members of this binding that are essential for understanding the present invention have been represented.

With reference to FIG. 1, binding element 1 comprises a body 2 connected to a base 3 which is affixed to the ski by any appropriate means, for example, by screws. Seen from the top, the base is shaped like a rearwardly open "U", with two lateral arms 3*a* and 3*b*.

The body may be vertically mobile with respect to the base, for example, by a deformable connection, but this is not essential for the invention.

Body 2 bears a jaw 4 for retaining the front end of the boot. Jaw 4 comprises two lateral retention wings 5 and 6, respectively journaled to body 2 about substantially vertical axes 7 and 8. Jaw 4 also comprises a vertically retaining sole clamp 12 of the boot. Here, the sole clamp is associated, in different portions respectively, with two wings.

Wings 5 and 6 are laterally movable in response to biases of the boot, against the return force applied thereto by a spring 15.

Spring 15 is housed in the body. It actuates a piston 16 also housed and guided in the body for a longitudinal translational movement. The figures show that the piston is housed and guided in a housing 17 of the body, and that the spring is engaged inside the piston. Its front end is in support against the bottom of the piston, located on the front side of the binding element. Furthermore, a screw 20, whose head is retained by the front of the body, crosses the piston and the spring and has a nut 21 towards the rear which retains the rear end of the spring. A rotation of the screw drives the spring in translation, which enables adjustment of the initial compression of the spring.

Beyond their journal axes 7 and 8, wings 5 and 6 have a small arm 5*a*, 6*a* which drives piston 16 rearwardly while taking support against a shoulder 23 located in the upper rear portion of piston 16.

Binding element 1 further comprises a support device 25 for the front end of the sole of the boot.

The support device has a support plate 26 on which the sole of the boot rests. Plate 26 may be equipped in its upper portion with any appropriate coating intended to facilitate lateral sliding of the boot, for example, a PTFE coating. It is approximately as wide as the ski in this area.

According to the invention, support plate 26 on which the boot rests is connected to a support structure to enable the support plate to oscillate in a rocking motion on either side of a nominal position in which it provides the boot with a substantially horizontal support surface.

According the illustrated embodiment, the support plate is journaled in rotation about a horizontal and longitudinal axis by means of a pin or axle 28 located towards the center of the width of the plate i.e., towards a vertical median plane of the plate.

Axle 28 is borne by two lugs 29 and 30 which extend from a plate 31. Plate 31 extends beneath support plate 26, against the upper surface of the ski. For example, it is connected to base 3 beneath its arms 3*a* and 3*b*, in the area of the openings for assembling the base on the ski.

As for the support plate, it has two vertical legs 35, 34 which are crossed by axle 28.

A linking means that reacts to the rocking motions of support plate 26 further connect the support device to the energy spring. This linking means exerts on the spring a force which reduces the return force that the spring itself exerts on the lateral retention wings. In the case of a rocking bias exerted on the support plate, the boot is released relatively more easily. This especially compensates for the friction and other effects which brake the lateral movement of the boot in case the latter twists in its retention jaw.

In the embodiment of FIGS. 1 to 4, the linking means comprise a pedal 36, mobile along a substantially vertical direction. The pedal extends beneath support plate 26, and extends frontwardly and rearwardly. Beneath the support plate, support element 26 and pedal 36 have a similar width and are in contact with one another at least along the lateral edges of the support plate. In this area, support plate 26 can have support means such as middle soles, 26*a* and 26*b*. In its central portion, the pedal has a large recess 37 that crosses the journal legs of support plate 26.

Pedal 26 extends rearwardly where it is journaled about a horizontal and transverse axis 38 borne by plate 31, for example, by legs 40 and 41 perpendicular to the upper surface of plate 31.

Because of this journal, a rocking motion of support plate 26 drives pedal 36 along a rotational movement about axis 38.

Towards the front, pedal 36 has a tongue 39, which is engaged between arms 3*a* and 3*b* of base 3. The tongue has a reduced width with respect to the rest of the pedal.

Towards the front, tongue 39 is in support on the approximately horizontal arm 42 of a pivotal element 43. The pivotal element is generally located generally between both arms 3*a* and 3*b* of the base, substantially plumb with the rear end of piston 16. It is journaled about a horizontal and transverse axis 44 whose ends are housed in arms 3*a* and 3*b*. Above axis 44, the pivotal element is extended by a vertical arm shaped like a two-pronged fork 45 and 46 which partially overlaps the lower portion of piston 16. The prongs are in front-to-rear support against two lateral lugs 47 and 48 that the piston has in its lower rear portion.

The assembly has the shapes and dimensions such that in the nominal resting position of the binding, arm 42 of pivotal element 43 is substantially raised, and keeps tongue 39 raised on the pedal. The pedal maintains the support plate in a stable horizontal position. From this position the pedal can be lowered, and the pivotal element can pivot in the clockwise direction, for FIG. 1.

A rocking bias from either side exerted on support plate 26 forces pedal 36 downwardly. The pivotal element pivots in the clockwise direction which drives piston 16 rearwardly, thus initiating the required course it must take so that the boot is released by one or the other of the retention wings.

Upon cessation of the bias, spring 15 returns the entirety of the mobile members of the binding element to their nominal position.

Support plate 26 is sensitive to a rocking bias. This bias can be induced in the case of a front-torsion fall accompanied by a twisting of the boot about a longitudinal and horizontal axis with respect to its binding.

The support plate is also sensitive to a bias of the boot induced by a front-torsion fall without twisting of the boot. Indeed, in the case of such a strong bias, the vertical pressure exerted by the boot on its support is maximized after the front of the boot is displaced laterally, so that the support plate tilts while biasing pedal 36, although, strictly speaking, there is no rocking bias.

In the embodiment described hereinabove, the linking means transmit to the piston, i.e., to the return spring, the rocking biases of the support plate. This particular configuration is considered to be non-limiting, and the linking means could actuate another member of the binding element.

Figure 5:
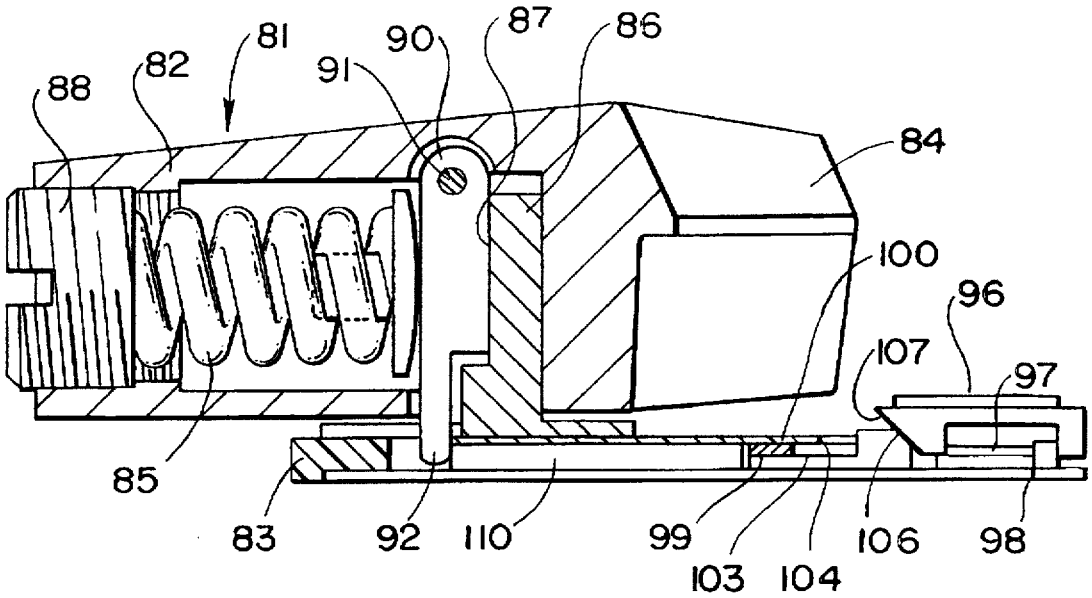
FIG. 5 represents a side and partial sectional view of a binding element according to another embodiment of the invention.

FIG. 5 illustrates an embodiment variation according to which front binding element 81 has a base 83 overlaid by a vertical pivot 86. A body 82 is mounted and journaled about pivot 86. Boot retention jaw 84 forms a one-piece assembly with body 82.

The piston has a flat portion 87 on the front against which the end of a spring 85, housed in the body, takes support. The other end of the spring is in support against a plug 88 screwed in the body.

A journaled lever 90 is inserted between the end of spring 85 and flat portion 87. Lever 90 is journaled about a horizontal and transverse pin 91 which is located above spring 85. Furthermore, it has a lower end 92 which redescends at the level of base 83.

Furthermore, binding element 81 has a boot support element 96 which is journaled about a longitudinal axle 97 borne by a plate 98 located behind base 83 and affixed thereto. The support plate can oscillate in a rocking motion about the longitudinal axis.

Linking means connect the support plate to a mobile member of the binding element, in this case lever 90 which is inserted between the spring and the flat portion of the pivot.

Figure 6:
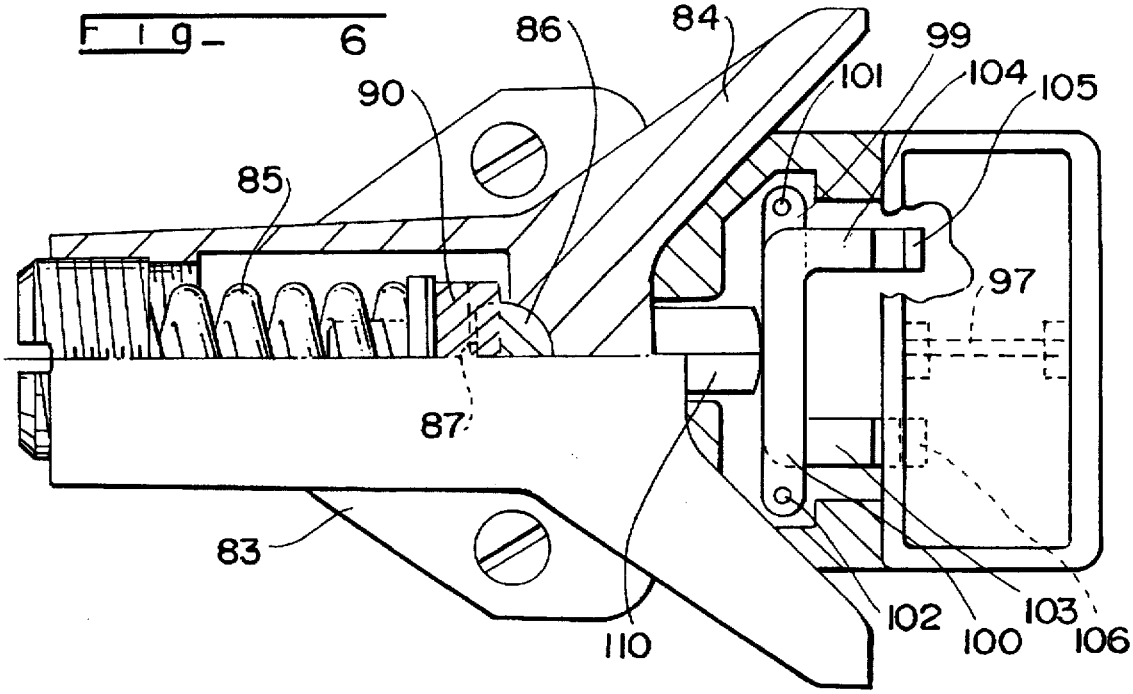
FIG. 6 represents the binding element of FIG. 5 from a top and partial sectional view along the upper half-view.

The linking means comprise two transverse connecting rods 99 and 100, superposed along a portion of their length. Each connecting rod is journaled about a vertical axis 101, 102, extends from this axis along a transverse direction, and has a return 103, 104 on the other side of the median longitudinal axis of the binding element, such return being oriented perpendicularly towards support plate 96. Each return has a ramp 105, 106 constituted by a surface inclined from top-to-bottom and front-to-rear, which is partially engaged beneath support plate 96 and cooperates with a complementary ramp of the support plate. Only ramp 107 is visible in FIGS. 5 and 6. In the vicinity of the median longitudinal axis of the binding element, the two connecting rods cross each other and are both in support against a pusher 110 guided for a longitudinal translational movement in a housing of base 83. The front end of the pusher presses against the lower end of lever 90.

A rocking motion of the support plate on either edge generates a rotational movement of one or the other connecting rod 99, 100 about its respective axis 100, 101. The connecting rod driven into motion pushes pusher 110 frontwardly, which in return forces lever 90 to compress spring 85. This compression of the spring reduces the force in the same proportion that the boot must transmit to the jaw to generate its lateral pivoting until said jaw releases the sole of the boot.

The invention is not limited to the embodiments described hereinabove. Numerous variations are possible, in particular for adapting the linking means to the energy mechanism of the binding element.

Furthermore, it is understood that one could laterally offset the journal axis about which the boot support plate pivots. Similarly, one could incline this axis with respect to the longitudinal direction. All this would, in fact, favor one side of the boot with respect to the other.

The instant application is based upon French patent application 93.08912 of Jul. 16, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed:

1. A binding for retaining a boot on an alpine ski, said binding comprising:

a base for attachment to a ski;

a body mounted on said base;

a retention jaw borne by said body, said retention jaw comprising two laterally opposed retention wings for laterally retaining the boot and a sole clamp for vertically retaining the boot;

a spring housed in said body for elastically opposing release movements of said jaw in response to forces transmitted by the boot;

a support plate for supporting a sole of the boot;

means for defining a rocking motion of said support plate about a predetermined longitudinal axis fixed relative to the ski, said longitudinal axis being parallel to a longitudinal direction of the ski;

a linking device for reducing a predeterminate resistance force to be overcome by the boot for release of the boot from the retention jaw in response to a force exerted on said support plate for generating said rocking motion of said support plate about said longitudinal axis.

2. A binding according to claim 1, wherein:

said linking device for reducing a predeterminate resistance force comprises means for linking said support plate to a movable element of the binding, said means for linking further comprises means for generating a compensating force to said movable element of the binding in response to sensing said rocking motion of said support plate for reducing said predeterminate resistance force to be overcome by the boot for release of the boot from the retention jaw.

3. A binding according to claim 1, wherein:

said means for defining a rocking motion of said support plate comprises a longitudinally oriented journal axle.

4. A binding according to claim 1, wherein:

said longitudinal axis of said support plate is substantially laterally offset with respect to said vertical median plane of said support plate.

5. A binding according to claim 2, wherein:

said movable element of the binding to which said support plate is linked by said means for linking comprises said spring.

6. A binding according to claim 2, wherein:

said movable element of the binding to which said support plate is linked by said means for linking comprises an element via which said spring exerts an elastic return force on said jaw.

7. A binding according to claim 1, wherein:

said linking device comprises a pedal and a horizontal and transverse axle about which said pedal is mounted for journalled movement; and said pedal is configured and arranged so that said journalled movement of said pedal is caused by said rocking movement of said support plate.

8. A binding according to claim 7, wherein:

said support plate is position to have a support surface for the boot above said pedal and said support plate and said pedal have respective engagement surfaces, said engagement surfaces being offset with respect to said longitudinal axis of said support plate, whereby said rocking motion of said support plate induces said journalled movement of said pedal in a vertical direction.

9. A binding according to claim 8, wherein:

said linking device further comprises a journalled pivotal element;

said axle of said pedal is positioned at one end of said pedal, an end opposite said one end of said pedal being in supporting engagement with one arm of said pivotal element; and said pivotal element having a further arm in operative engagement with said spring.

10. A binding according to claim 5, wherein:

said linking device further comprises a pusher in operative engagement with said spring;

said linking device further comprising two transverse connecting rods journalled about respective vertical axles, said axles being transversely spaced apart;

said support plate includes at least one ramp and each of said connecting rods includes a ramp, said at least one ramp of said support plate being in operative engagement with said ramps of said connecting rods for exerting a force against said pusher for transmitting said force via said pusher to said spring.

11. A binding according to claim 6, wherein:

said linking device further comprises a pusher in operative engagement with said spring;

said linking device further comprising two transverse connecting rods journalled about respective vertical axles, said axles being transversely spaced apart;

said support plate includes at least one ramp and each of said connecting rods includes a ramp, said at least one ramp of said support plate being in operative engagement with said ramps of said connecting rods for exerting a force against said pusher for transmitting said force via said pusher to said spring.

12. A binding according to claim 1, wherein:

said retention jaw is shaped for engaging a front portion of the boot.

13. A binding for retaining a boot on an alpine ski, said binding comprising:

a base for attachment to a ski;

a body mounted on said base;

a retention jaw borne by said body, said retention jaw comprising two laterally opposed retention wings for laterally retaining the boot and a sole clamp for vertically retaining the boot;

a spring housed in said body for elastically opposing release movements of said jaw in response to forces transmitted by the boot;

a support plate for supporting a sole of the boot, said support plate includes opposite lateral ends;

a support structure, said support plate being connected to said support structure to enable either of said opposite lateral ends of said support plate to move downwardly about an axis fixed with respect to the ski in response to a torsional force exerted by the boot;

a linking device for reducing a predeterminate resistance force to be overcome by the boot for release of the boot from the retention jaw in response to a force exerted on said support plate for generating said rocking motion of said support plate.

14. A binding according to claim 13, wherein:

said linking device for reducing a predeterminate resistance force comprises means for linking said support plate to a movable element of the binding, said means for linking further comprises means for generating a compensating force to said movable element of the binding in response to sensing said rocking motion of said support plate for reducing said predeterminate resistance force to be overcome by the boot for release of the boot from the retention jaw.

15. A binding according to claim 13, wherein:

said support structure comprises a journal located between said opposite lateral ends of said support plate.

16. A binding according to claim 13, wherein:

said fixed axis extends along a longitudinal axis of the binding, said longitudinal axis of the binding adapted to extend within a longitudinal vertical median plane of the ski.

17. A binding according to claim 13, wherein:

said fixed axis extends parallel to and offset from a longitudinal vertical median plane of said support plate.

18. A binding according to claim 13, wherein:

said fixed axis extends substantially obliquely with respect to a longitudinal vertical median plane of the ski.

19. A binding according to claim 14, wherein:

said movable element of the binding to which said support plate is linked by said means for linking comprises said spring.

20. A binding according to claim 14, wherein:

said movable element of the binding to which said support plate is linked by said means for linking comprises an element via which said spring exerts an elastic return force on said jaw.

21. A binding according to claim 13, wherein:

said linking device comprises a pedal and a horizontal and transverse axle about which said pedal is mounted for journalled movement; and said pedal is configured and arranged so that said journalled movement of said pedal is caused by said rocking movement of said support plate.

22. A binding according to claim 21, wherein:

said support plate is position to have a support surface for the boot above said pedal and said support plate and said pedal have respective engagement surfaces, said engagement surfaces being offset with respect to said longitudinal axis of said support plate, whereby said rocking motion of said support plate induces said journalled movement of said pedal in a vertical direction.

23. A binding according to claim 22, wherein:

said linking device further comprises a journalled pivotal element;

said axle of said pedal is positioned at one end of said pedal, an end opposite said one end of said pedal being in supporting engagement with one arm of said pivotal element; and said pivotal element having a further arm in operative engagement with said spring.

24. A binding according to claim 19, wherein:

said linking device further comprises a pusher in operative engagement with said spring;

said linking device further comprising two transverse connecting rods journalled about respective vertical axles, said axles being transversely spaced apart;

said support plate includes at least one ramp and each of said connecting rods includes a ramp, said at least one ramp of said support plate being in operative engagement with said ramps of said connecting rods for exerting a force against said pusher for transmitting said force via said pusher to said spring.

25. A binding according to claim 20, wherein:

said linking device further comprises a pusher in operative engagement with said spring;

said linking device further comprising two transverse connecting rods journalled about respective vertical axles, said axles being transversely spaced apart;

said support plate includes at least one ramp and each of said connecting rods includes a ramp, said at least one ramp of said support plate being in operative engagement with said ramps of said connecting rods for exerting a force against said pusher for transmitting said force via said pusher to said spring.

26. A binding according to claim 13, wherein:

said retention jaw is shaped for engaging a front portion of the boot.

27. A binding according to claim 1, wherein:

said release movements of said jaw comprise release movements laterally with respect to said support plate.

28. A binding according to claim 1, wherein:

said rocking motion of said support plate includes motion from a nominal position, in which said support plate is in a substantially horizontal and substantially centered position with respect to a longitudinal median plane of the ski during engagement of the boot with the binding, to a release position, in which said support plate is in a tilted and substantially centered position with respect to a longitudinal median plane of the ski.

29. A binding according to claim 13, wherein:

said release movements of said jaw comprise release movements laterally with respect to said support plate.

30. A binding according to claim 13, wherein:

said rocking motion of said support plate includes motion from a nominal position, in which said support plate is in a substantially horizontal and substantially centered position with respect to a longitudinal median plane of the ski during engagement of the boot with the binding, to a release position, in which said support plate is in a tilted and substantially centered position with respect to a longitudinal median plane of the ski.

31. A binding for retaining a boot on an alpine ski, said binding comprising:

a base for attachment to a ski;

a body mounted on said base;

a retention jaw borne by said body, said retention jaw comprising two laterally opposed retention wings for laterally retaining the boot and a sole clamp for vertically retaining the boot, said retention jaw being connected to said body for enabling release movement in response to forces transmitted by the boot;

a spring housed in said body for elastically opposing said release movement of said jaw;

a support plate for supporting a sole of the boot;

a support structure, said support plate being connected to said support structure to define a rocking motion of said support plate about a predetermined axis fixed relative to the ski, said predetermined axis extending substantially longitudinally with respect to a longitudinal direction of the ski;

a linking device for reducing a predeterminate resistance force to be overcome by the boot for release of the boot from the retention jaw in response to a force exerted on said support plate for generating said rocking motion of said support plate about said predetermined axis.

32. A binding according to claim 31, wherein:

said release movement of said jaw comprises a release movement laterally with respect to said support plate.

33. A binding according to claim 31, wherein:

said rocking motion of said support plate includes motion from a nominal position, in which said support plate is in a substantially horizontal and substantially centered position with respect to a longitudinal median plane of the ski during engagement of the boot with the binding, to a release position, in which said support plate is in a tilted and substantially centered position with respect to a longitudinal median plane of the ski.

* * * * *